US005661501A

United States Patent [19]

Tanamachi

[11] Patent Number: 5,661,501

[45] Date of Patent: Aug. 26, 1997

[54] DRIVING METHOD OF PLASMA-ADDRESSED DISPLAY DEVICE

[75] Inventor: Shoichi Tanamachi, Kanagawa, Japan

[73] Assignee: Sony Corporation, Tokyo, Japan

[21] Appl. No.: 543,279

[22] Filed: Oct. 16, 1995

[51] Int. Cl.[6] ..... G09G 3/10

[52] U.S. Cl. ..... 345/60; 313/234; 313/585; 315/169.1; 315/169.4; 345/90; 345/204

[58] Field of Search ..... 313/234, 582, 313/584, 585, 586, 631; 315/169.4, 169.1, 168; 345/37, 42, 60, 66, 67, 68, 90, 98, 204, 210; 365/116

[56] References Cited

U.S. PATENT DOCUMENTS

| | | | |
|---|---|---|---|
| 3,801,863 | 4/1974 | Lee | 315/169 R |
| 3,811,071 | 5/1974 | Ogle | 315/169 R |
| 4,130,777 | 12/1978 | DeJule | 315/169 |
| 4,147,959 | 4/1979 | Bonn | 340/779 |
| 4,772,884 | 9/1988 | Weber et al. | 340/776 |
| 4,896,149 | 1/1990 | Buzak et al. | 340/794 |
| 5,077,553 | 12/1991 | Buzak | 340/794 |
| 5,272,472 | 12/1993 | Buzak et al. | 345/60 |
| 5,313,223 | 5/1994 | Buzak et al. | 345/60 |
| 5,440,201 | 8/1995 | Martin et al. | 313/582 |
| 5,453,660 | 9/1995 | Martin et al. | 313/582 |

FOREIGN PATENT DOCUMENTS 6-289808 10/1994 Japan .

*Primary Examiner*—Mark R. Powell
*Assistant Examiner*—Vincent E. Kovalick
*Attorney, Agent, or Firm*—Hill, Steadman & Simpson

[57] ABSTRACT

In a driving method capable of selectively scanning discharge channels in a stable and efficient manner using an open-cell structure, a plasma-addressed display device comprises a display cell, a plasma cell, a scanner, a supply and a controller. The display cell is equipped with data electrodes arranged so as to be mutually parallel. The plasma cell is for creating discharge channels formed in such a manner as to be orthogonal with respect to the data electrodes and has anodes and cathodes alternately arrayed in such a manner as to be shared between adjacent discharge channels. The scanner is for carrying out selective scanning of the discharge channels. The supply is for applying a data voltage to the data electrodes. The controller is for controlling the maximum value of the voltage across the cathodes and anodes, the data electrodes and anodes and the data electrodes and cathodes of each of the discharge channels in such a manner as to not exceed a prescribed plasma discharge start voltage at periods other than periods of plasma discharge.

7 Claims, 6 Drawing Sheets

DRIVING METHOD OF PLASMA-ADDRESSED DISPLAY DEVICE

BACKGROUND OF THE INVENTION

1. Field of the Invention

The present invention relates to a method for driving a display cell equipped with rows of data electrodes and a plasma cell equipped with parallel discharge channels overlaid so as to comprise a flat plasma-addressed display device and more particularly relates to a method for controlling voltages applied to the data electrodes, anodes and cathodes.

2. Description of Related Art

A plasma-addressed display device of the structure shown in FIG. 8 has been previously disclosed in U.S. Pat. No. 4,896,149 to Buzak (Issue date: Jan. 23, 1990) or U.S. Pat. No. 5,077,553 to Buzak (Issue date: Dec. 31, 1991). The disclosure of the noted references are hereby incorporated herein. This plasma-addressed display device has a flat panel structure where an intermediate substrate 103 comprised of a thin glass sheet etc. is sandwiched between a liquid crystal cell 101 and a plasma cell 102. The plasma cell 102 is constructed using a lower substrate 104, with a plurality of parallel channels 105 being provided on the surface of the lower substrate 104. Each of the channels 105 are made air-tight by the intermediate substrate 103 with ionizable gas being enclosed so as to form individually separated discharge channels 106. Concave portions 107 between each of the channels 105 play the part of barrier ribs or ribs for dividing the individual discharge channels 106 and also act as gap spacers for the lower substrate 104 with respect to the intermediate substrate 103. Parallel pairs of electrodes 108 and 109 at the lower parts of each of the channels 105. These pairs of electrodes function as anodes and cathodes for ionizing the gas within the discharge channels 106 and for creating plasma discharges.

On the other hand, the liquid-crystal cell 101 is equipped with a liquid-crystal layer 111 sandwiched between the intermediate substrate 103 and the upper substrate 110, with stripe-shaped data electrodes being formed on the inner surface of the upper substrate 110. These data electrodes 112 are at right angles with respect to the discharge channel 106. Matrix-shaped pixels are therefore defined at the portions where the data electrodes 112 that act as rows of driving units and the discharge channels 106 that act as lines of scanning units cross-over with each other.

With this display device, the discharge channels 106 for carrying out the plasma discharges and the data electrodes 112 on the side of the liquid-crystal cell 101 are scanned simultaneously in a linearly sequential manner, with the desired image then being displayed by applying an analog data voltage. If a plasma discharge is created in the discharge channel, the approximate anode potential is maintained within the discharge channel. If a data voltage is then applied to the data electrodes 112 under these conditions, data may be written to each of the pixels of the liquid-crystal layer 111 via the intermediate substrate 103. When the plasma discharge is complete, the discharge channels 106 go to a floating potential and the written data is saved at each of the pixels. A so-called "sample-hold" operation is carried out, with the discharge channel 106 functioning as a sampling switch on the one hand and the liquid-crystal layer 111 functioning as a sampling capacitor. The liquid crystal is then operated in response to the sampled data and the lighting and extinguishing of the display devices is carried out in pixel units.

With the aforementioned panel structure, independently controlled anodes and cathodes are paired together so as to comprise a single discharge channel. However, each of the individual discharge channels are made to be air-tight by the intermediate substrate and the barrier ribs and construction is carried out in such a way that generated plasma does not leak over into adjacent discharge channels. Further, the driving waveforms are set-up so that the anode potential is taken as the value central to the maximum value and the minimum value of the data voltage. i.e. all of the anode electrodes are connected in common and maintained at a fixed potential. On the other hand, the cathode electrodes are sequentially scanned, with a sequential plasma discharge being generated every channel. However, 2n lines of electrodes (n lines of anodes and n lines of cathodes) are necessary to provide n discharge channels. Therefore, if a transmission-type structure is adopted for the plasma-addressed display device, there is a shortcoming in that the ratio of the display surface area occupied by the electrodes is increased, with the picture being covered by a corresponding extent, which results in the open area ratio being reduced. Because of this, a discharge channel structure to reduce the number of lines of electrodes by half was disclosed in, for example, Japanese Laid-open Patent Publication Hei. 4-265931. According to this publication, the number of lines of electrodes may be halved by adopting a structure where anodes and cathodes arranged alternately in a matrix are shared by respective adjacent discharge channels. In the following, this shall be referred to as the open-cell structure. It is therefore an object of the present invention to provide a driving method capable of selectively scanning discharge channels in a stable and efficient manner using an open-cell structure.

SUMMARY OF THE INVENTION

As the present invention sets out to resolve the aforementioned problems, a plasma-addressed display device comprises a display cell, a plasma cell, a scanner, a supply and a controller. The display cell is equipped with data electrodes arranged so as to be mutually parallel. The plasma cell is for creating discharge channels formed in such a manner as to be orthogonal with respect to the data electrodes and has anodes and cathodes alternately arrayed in such a manner as to be shared between adjacent discharge channels. The scanner is for carrying out selective scanning of the discharge channels. The supply is for applying a prescribed data voltage to the data electrodes. The controller is for controlling the maximum value of the voltage across the cathodes and anodes, the data electrodes and anodes and the data electrodes and cathodes of each of the discharge channels in such a manner as to not exceed a prescribed plasma discharge start voltage at periods other than periods of plasma discharge.

The controller may fix a data electrode voltage applied in a period from a plasma discharge occurring at one discharge channel to a plasma discharge starting at a following discharge channel and maintain anode potential at a value at the center of the maximum amplitude of the data voltage.

Individual barrier ribs may be formed on the anodes and cathodes or only on the anodes.

Further, according to the present invention, a method for driving a plasma-addressed display device having a display cell composed of data electrodes arranged so as to be mutually parallel and a plasma cell for creating discharge channels formed in such a manner as to be orthogonal with respect to the data electrodes having anodes and cathodes alternately arrayed in such a manner as to be shared between adjacent discharge channels, with the display cell and the plasma cell being overlaid, comprises the step of ensuring that during the displaying of an image the maximum voltage across a cathode and an anode, a data electrode and an anode and a data electrode and a cathode does not exceed a prescribed plasma discharge start voltage at periods other than when a plasma discharge is taking place at each of the discharge channels.

Image displaying is carried out in such a manner that sequential selection is carried out by applying prescribed voltages to the anodes and cathodes and sequentially creating plasma discharges at the discharge channels, and data voltages are applied to the data electrodes.

The voltage applied to the data electrodes is fixed and the anode potential is maintained as the central value of the maximum amplitude of the data voltage in the time between a plasma discharge at a discharge channel coming to an end and a plasma discharge starting at the following discharge channel.

A plasma discharge is generated when a voltage that exceeds a prescribed discharge start voltage is applied across the anodes and cathodes and stops when the voltage goes lower than a prescribed discharge maintaining voltage. According to the present invention, control is then exerted so that a voltage exceeding the discharge start voltage is not applied across the anodes and cathodes, the data electrodes and anodes or the data electrodes and cathodes during periods other than when data writing operations are being carried out, while a plasma discharge is being applied and discharge channels are being selectively scanned. If the difference between the voltages applied to the anodes, the cathodes and the data electrodes during periods where it was originally intended to halt the plasma discharge exceeds the discharge start voltage, plasma discharges occur across unintended electrodes and plasma switches that were not intended to be closed are closed. Data voltages corresponding to image information intended to be written to other pixels gets written to pixels which were not intended for plasma discharges. i.e. problems arise as a result of discharges due to information originally intended to be displayed not being properly controlled.

DETAILED DESCRIPTION OF THE PREFERRED EMBODIMENT

Embodiment

Figure 1A:
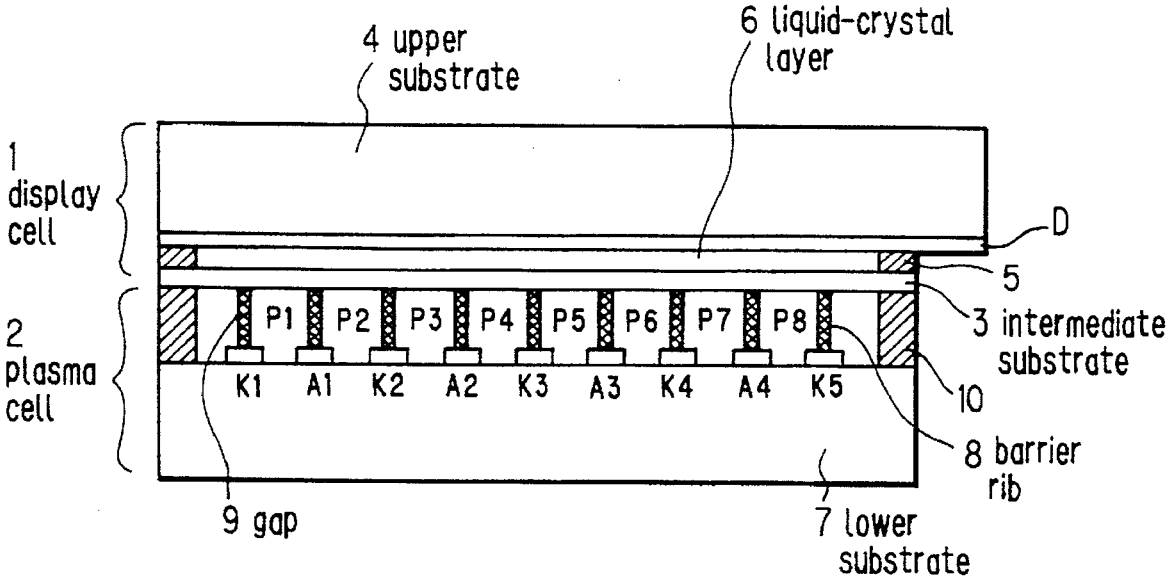
FIG. 1 (A) and (B) are a view describing the driving method for the plasma-addressed display device of the present invention.
Figure 1B:
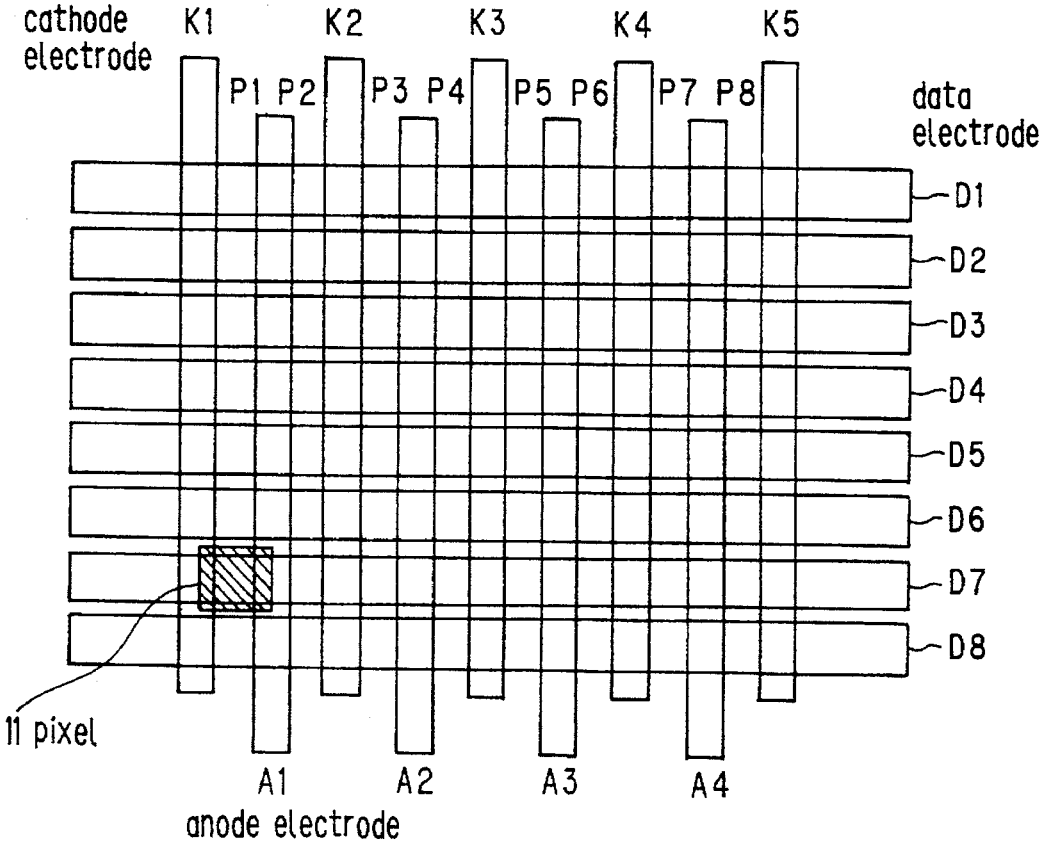

A method of driving a plasma-addressed display device of the present invention is described with reference to FIGS. 1(A) and 1(B). FIG. 1(A) is a view of a plasma cell device having an open-cell structure and FIG. 1(B) shows an electrode array. As shown in the drawings, the plasma-addressed display device is a laminated flat-panel structure with a intermediate substrate 3 comprised of a dielectric sheet being sandwiched between a display cell 1 and a plasma cell 2. The intermediate substrate 3 such as microsheet glass has to be thin enough to drive the display cell 1 and has, for example, a thickness of about 50 mm. The display cell 1 is constructed using a glass upper substrate 4, with a plurality of data electrodes D being formed in parallel rows on the inner surface of this upper substrate 4. The upper substrate 4 is bonded to the intermediate substrate 3 using a spacer 5 in such a manner that a gap is maintained between the upper substrate 4 and the intermediate substrate 3. This gap is filled with a liquid crystal layer 6 of electro-optical material. This gap is usually about 5 mm across and must be maintained evenly across the whole display. In this embodiment, liquid-crystal is used as the electro-optical material, but the present invention is by no means limited in this respect.

On the other hand, the plasma cell 2 is constructed using a lower glass substrate 7. Anodes A and cathodes K are then formed alternately on the inner surface of the lower substrate 7. Each anode and cathode are given specific numbers. For example, the first anode is expressed as A1 and the first cathode is expressed as K1. The anodes A and the cathodes K are arrayed so as to cross-over with the data electrodes D. Barrier ribs 8 are formed so as to follow up from the anodes A and the cathodes K with the tips of these barrier ribs 8 coming into contact with the intermediate substrate 3 so as to ensure that the gap size for the plasma cell 2 is fixed. These barrier ribs 8 may also only be formed on the anodes. Further, means other than barrier ribs may be formed for ensuring that the plasma cell gap dimensions are kept constant. A seal 10 comprised of low melting point glass etc. for bonding the intermediate substrate 3 and the lower substrate 7 is provided about the periphery of the lower substrate 7. An air-tight sealed gap 9 is left between the intermediate substrate 3 and the lower substrate 7, with an ionizable gas being enclosed within this gap 9. This gas may be selected from helium, neon, argon, xenon, or a compound thereof. The space 9 is divided by the barrier ribs 8 so as to form individual discharge channels P. Each individual discharge channel is shown with a number attached for identification, with, for example, the first discharge channel being expressed as P1. In the present invention, the anodes A and the cathodes K share adjoining discharge channels P. For example, the first anode A1 is exposed to both the first discharge channel P1 and the second discharge channel P2, while the second cathode K2 is exposed to both the second discharge channel P2 and the third discharge channel P3. If a prescribed voltage is then applied across a pair consisting of an anode A and a cathode K, then the enclosed gas may be selectively ionized and a corresponding discharge channel may be selected. For example, if a prescribed voltage is applied across the anode A1 and the cathode K1, the discharge channel P1 is selected. A crossover point of the discharge channel P and the data electrode D then stipulates an individual pixel 11.

Next, a driving method will be described with reference to FIG. 1. Basically, selective scanning is carried out where prescribed voltages are applied across the anodes A and the cathodes K so that plasma discharges are generated sequentially at the discharge channels P. At the same time, prescribed data voltages are applied to the data electrodes D and an image is displayed. At this time, the selection method may be such that the discharge channels P1 to P8 are scanned sequentially one at a time so that one frame may be taken as one picture. Alternatively, every other discharge channel P may be selected so that a picture is constructed using two frames. For example, scanning may be carried out so that odd numbered discharge channels P1, P3, P5 and P7 may be selected using the first frame and even numbered discharge channels P2, P4, P6 and P8 may be selected using the second frame. Whichever way is chosen, the driving method of the present invention is characterized in that the maximum values of the voltages across the cathodes K and the anodes A, the voltages across the data electrodes D and the anodes A, and the voltages across the data electrodes K and the cathodes K are controlled so as not to exceed a prescribed plasma discharge start voltage at periods when discharge channels P are not generating a plasma discharge. For example, if the discharge channel P2 is selected and a plasma discharge is generated, at this period the adjacent discharge channels P1 and P3 are not selected. At this time, a voltage exceeding the plasma discharge start voltage is applied across the selected anode A1 and cathode K2. On the other hand, the voltage across the selected anode A1 and the un-selected cathode K1 is controlled so as not to exceed the plasma discharge start voltage. Further, the voltage across all of the data electrodes D and the un-selected anodes A is also controlled so as not to exceed the discharge start voltage. The voltage across all of the data electrodes D and the un-selected cathodes K is also controlled so as not to exceed the discharge start voltage.

Figure 2:
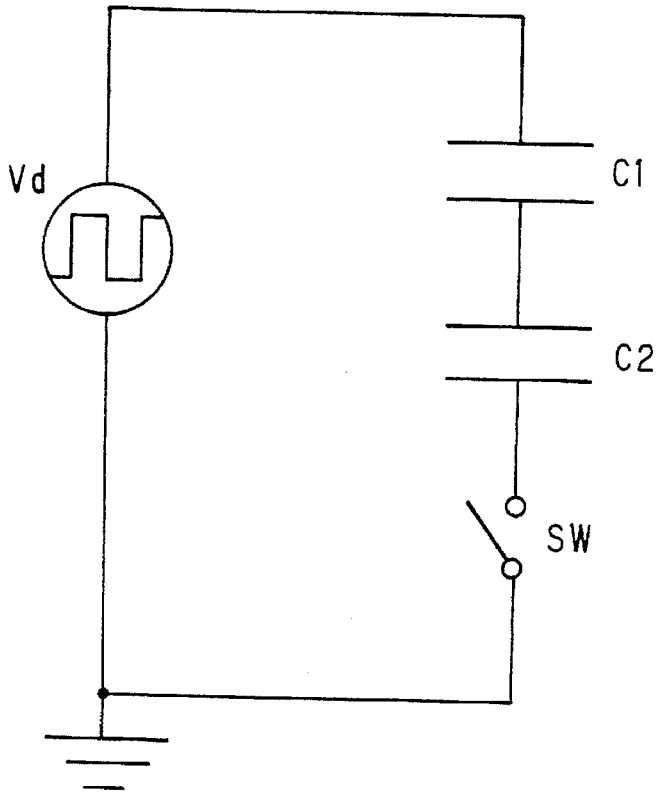
FIG. 2 is a view of an equivalent circuit corresponding to one pixel of the plasma-addressed display device.

FIG. 2 is an equivalent circuit for one pixel. The plasma switch SW expresses the function of the discharge channel P. When a plasma discharge is generated, the switch conducts and the data voltage Vd is applied to the pixel. This data voltage Vd is divided between a capacitance C1 comprised of the liquid crystal and the capacitance C2 of the intermediate substrate and is written to the pixel. When the plasma discharge is halted, the plasma switch SW opens and potential accumulated at the liquid crystal capacitance C1 and the intermediate substrate capacitance C2 is saved. The optical qualities of the liquid-crystal layer therefore change as a result of this operation and the written information is displayed. The operation as a display device therefore consists of the operation of writing data during the period when a plasma discharge is generated, fixing the data in the period directly after the plasma discharge has halted and holding data in the non-selection period until the plasma discharge is started using the next frame and the data is written. The plasma switch SW is open during the holding period and a data voltage decided using a limit fixing operation so that a voltage exceeding the discharge start voltage is not applied across each of the electrodes is maintained.

Figure 3:
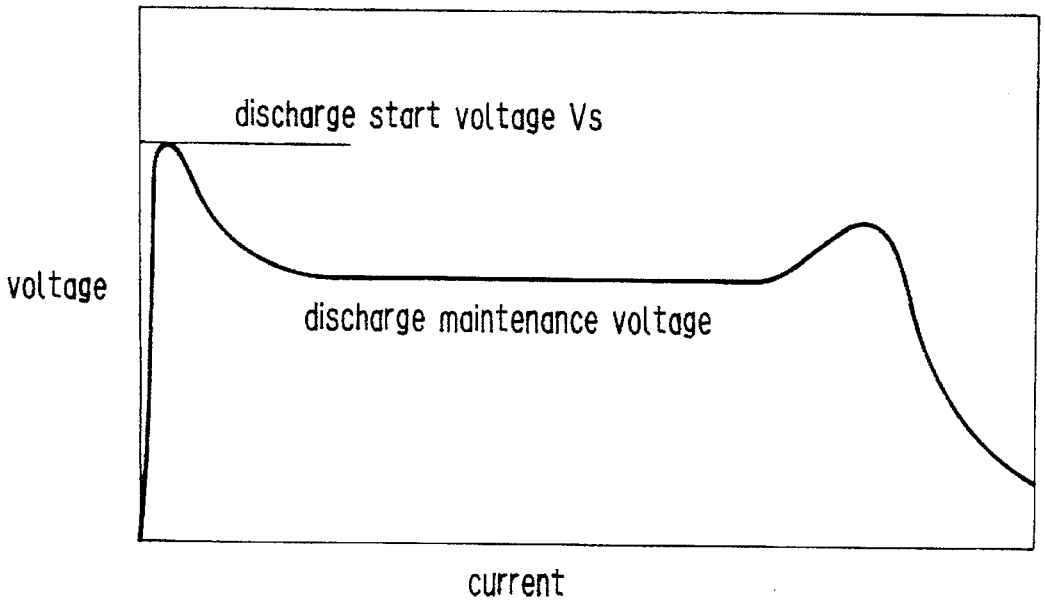
FIG. 3 is a graph showing the discharge channel voltage/current characteristics.

FIG. 3 is a graph showing the current-voltage characteristics of the plasma discharge. The plasma discharge starts when the voltage applied across the electrodes exceeds the prescribed discharge start voltage and stops when the voltage becomes lower than a prescribed discharge maintenance voltage. While the plasma discharge is being applied and scanning of the discharge channels is being carried out, control is exerted so that not only is the voltage across the anodes and cathodes controlled so as not to exceed the start discharge voltage for the duration of operations other than write operations but also the voltage across the data electrodes and anodes and the voltage across the data electrodes and cathodes is also controlled so as not to exceed the discharge start voltage Vs. Further, if the difference between the voltages applied to the anodes, cathodes and data electrodes exceeds the discharge start voltage Vs for an unspecified duration when it was not originally intended to have a discharge, a plasma discharge will occur between unspecified electrodes and plasma switches that were not intended to conduct will conduct. Applied data voltages corresponding to information to be written to other pixels may then be mistakenly written to pixels for which unspecified discharges have occurred. i.e. information originally intended to be displayed may be destroyed by un-controlled, unspecified plasma discharges.

Figure 4:
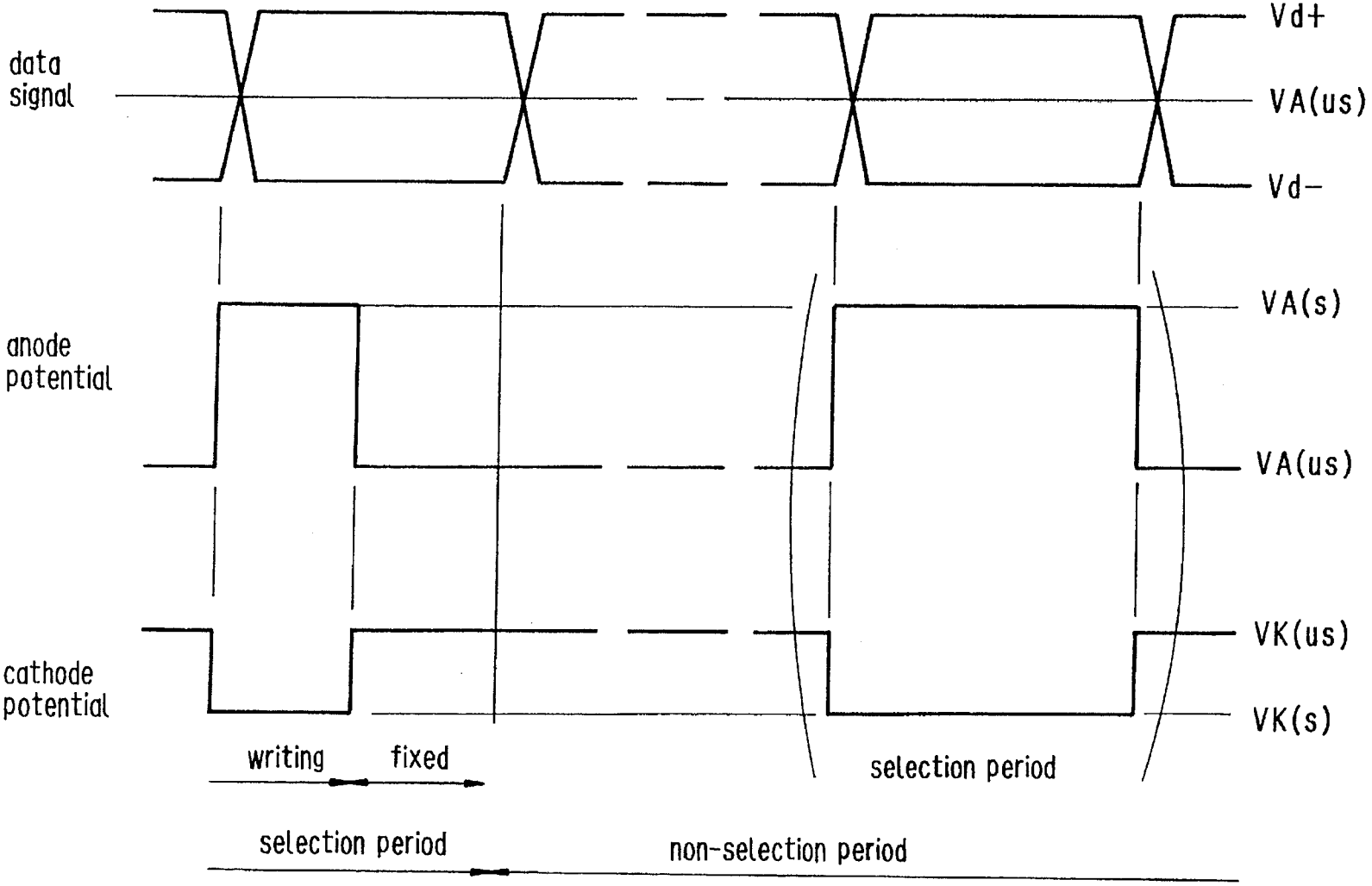
FIG. 4 is a wave diagram showing the operation waveforms used in the plasma-addressed display device driving method of the present invention.

FIG. 4 shows specific examples of a driving waveforms used with the driving method of the present invention. In this example, the data signal is given as the data voltage fluctuating between a maximum amplitude Vd+ and a minimum amplitude Vd−. The central value is then made so as to coincide with the anode potential VA(us) at the time of non-selection so that the application of direct current (dc) is prevented. i.e. $((Vd+)-(Vd-))/2=VA(us)$. Further, the maximum potential of the data electrodes is kept lower than the anode potential VA(s) at the time of selection. i.e. $VA(s) > VA(us)+(Vd+)$. The cathode potential VK(us) at the time of non-selection is set-up to be equal to the anode potential VA(us) at the time of non-selection. Moreover, setting-up is carried out so that a voltage that exceeds the discharge start voltage Vs is only applied across both electrodes when an anode and cathode are selected at the same time. i.e. the relationships $Vs<VA(s)-VK(s)$, $Vs>VA(s)-VA(us)$, and $Vs>VK(us)-VK(s)$ are maintained. If these settings are used, a voltage exceeding the discharge start voltage Vs is not applied to the anodes and cathodes at times other than times of selection. Regarding pairs of anodes and cathodes, writing of the data voltage is carried out in the first half of the selection period and the fixing operation is carried out in the second half. After this, the fixed data voltage is maintained without modification at the non-selection period. During this time, the voltage applied to the data electrodes is fixed between the time of the plasma discharge occurring at the corresponding discharge channel coming to an end and plasma discharge starting using the next discharge channel, and the potential of the anode electrodes is kept at the central value of the maximum amplitude of the data voltage. In order to make the voltage waveforms easy to see, the writing period and the fixing period have been put together and listed together with the selection period, as shown in FIG. 4.

Figure 5:
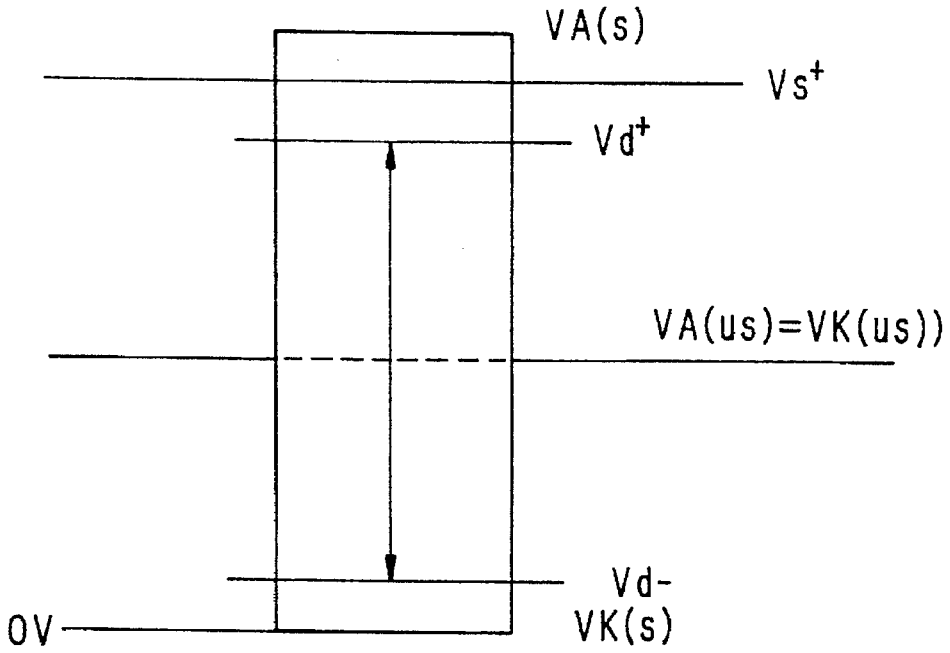
FIG. 5 is a schematic view showing the voltage levels applied to the data electrodes, the cathodes and the anodes.

FIG. 5 is a detailed schematic view showing the relationship between potential levels. As can be understood from the drawing, the central value of the maximum value Vd+ of the data voltage and the minimum value Vd− is set up so as to coincide with the anode potential VA(us) at the time of non-selection and the cathode potential VK(us) at the time of non-selection is set-up so as to be equal to the anode potential VA(us) at the time of non-selection. Further, on the one hand, the difference between the anode potential VA(s) during selection and the cathode potential VK(s) during selection is set-up so as not to exceed the discharge start voltage Vs, while on the other hand, the maximum value Vd+ of the data voltage is set-up so as not to exceed the discharge start voltage Vs.

Figure 6:
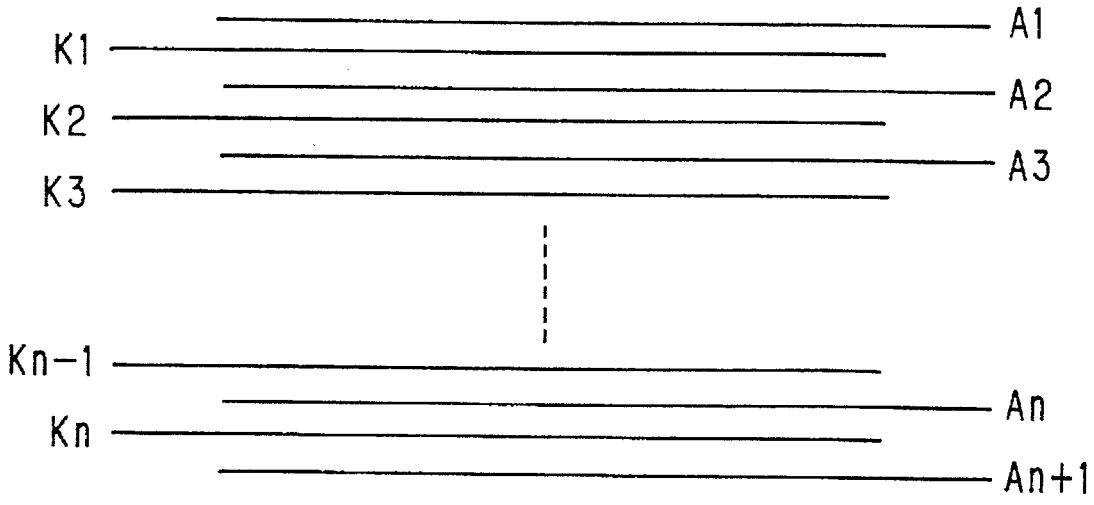
FIG. 6 is a view showing the pattern of a specific example of the electrode arrangement of the plasma-addressed display device.

Finally, a description will be given of a detailed example of actually driving the plasma-addressed display device using the driving waveforms shown in FIG. 4. FIG. 6 is a schematic view showing the arrangement of the electrodes for the plasma-addressed display device of this detailed example. In this example, an electrode structure is adopted where there is one more anode A than there are cathodes K.

Figure 7:
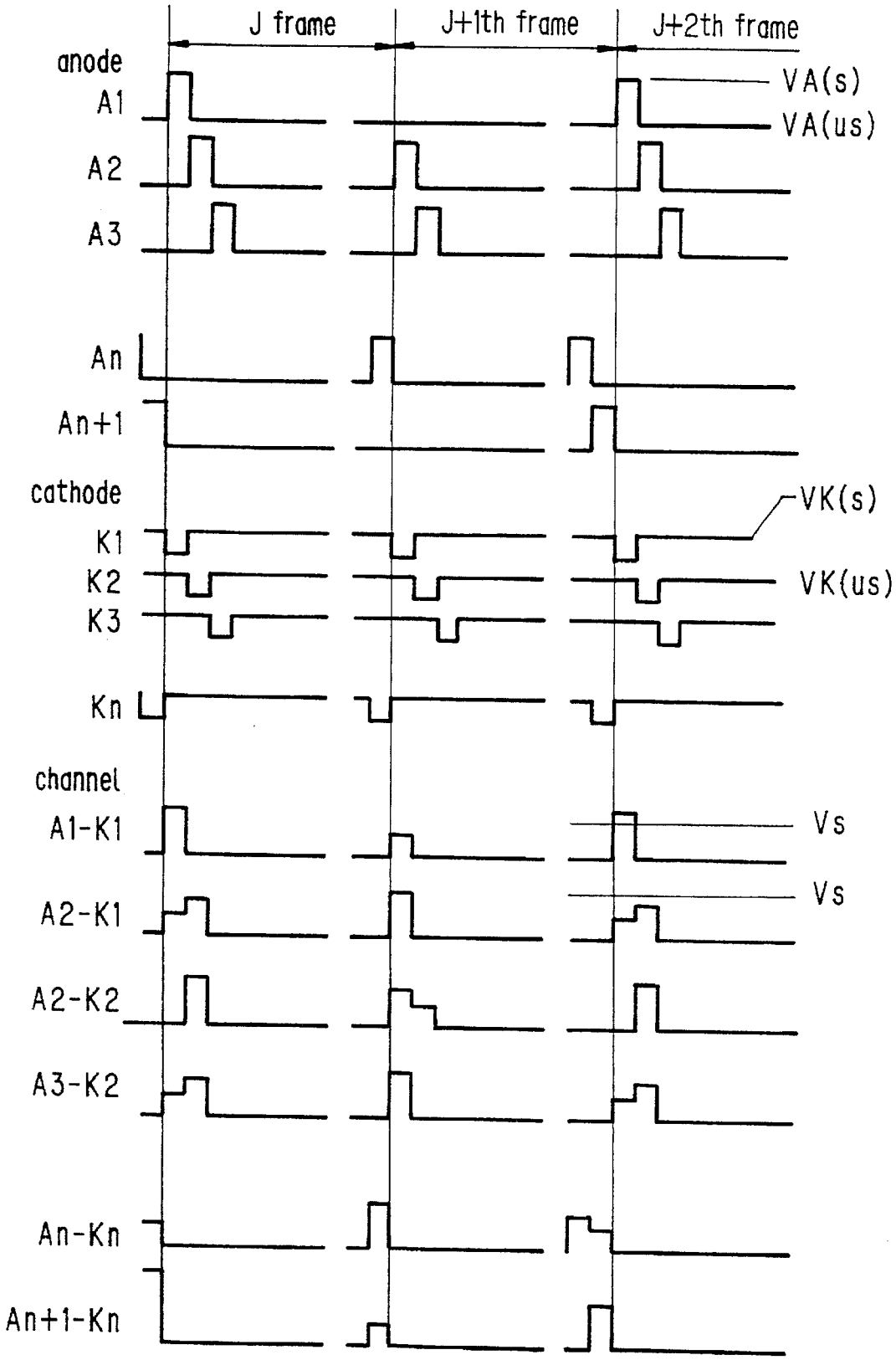
FIG. 7 is a timing chart showing a specific example of the driving method for the plasma-addressed display device of the present invention.
Figure 8:
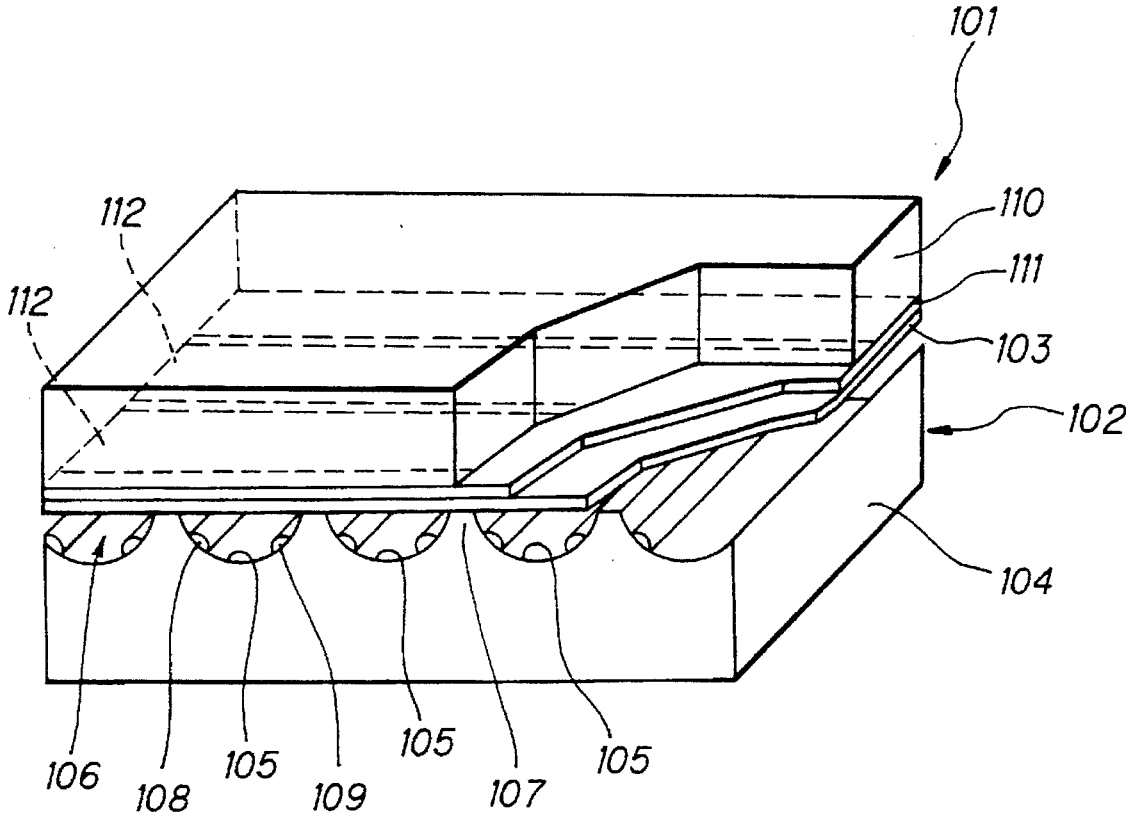
FIG. 8 is a schematic, partially cut-away oblique view showing an example of a plasma-addressed display device.

FIG. 7 is a timing chart showing the driving waveforms for the case where one picture is constructed from two frames with the electrode pattern shown in FIG. 6 and showing the voltage levels generated at each of the discharge channels. Control is exerted so that a voltage exceeding the discharge start voltage Vs is applied alternately on each frame and for every one adjacent discharge channel. For example, on the jth frame, a voltage VA(s) is applied to anode A1 in the first selection period and a voltage VK(s) is applied to the cathode K1 so that a pulse voltage exceeding the discharge start voltage Vs is applied to the discharge channel A1/K1. At this time, a voltage pulse VA(us)−VK(s) is applied to the adjacent discharge channel A2/K1 but a plasma discharge does not occur because the discharge start voltage Vs is not exceeded. The anode A2 and the cathode K2 are then selected in the second selection period and a plasma discharge occurs at the single row of discharge electrodes A2/K2. In this way the jth frame is completed, the next frame J+1 is gone onto, the anode A2 and cathode K1 are selected in the first selection period and plasma generation occurs at the corresponding discharge channel A2/K1. This discharge channel was not scanned in the recent jth frame. In this way, a single picture can be displayed using two frames, with it being possible to sequentially scan 2n discharge channels using 2n+1 rows of electrodes. This means that a display density of approximately twice that obtained in conventional examples where n discharge channels were scanned using 2n rows of electrodes is possible.

As described above, according to the present invention, un-stipulated plasma discharges may be controlled so that displaying may be stabilized and picture quality may be enhanced by exerting control in such a manner that the maximum value of the voltage across the cathodes and anodes, the voltage across the data electrodes and anodes and the voltage across the data electrodes and cathodes does not exceed a prescribed plasma discharge start voltage in the periods other than when plasma discharge is occurring at each of the discharge channels. By adopting this driving method, the stability and efficiency of operation of the open-cell structure plasma-addressed display device may be made more stable and efficient and raising of the aperture ratio may be achieved.

What is claimed is:

1. A plasma-addressed display device comprising:

a display cell having data electrodes arranged so as to be mutually parallel;

a plasma cell for creating discharge channels formed in such a manner as to be orthogonal with respect to the data electrodes, the plasma cell having anodes and cathodes alternately arrayed in such a manner as to be shared between adjacent discharge channels;

means for carrying out selective scanning of the discharge channels;

means for applying a data voltage to the data electrodes; and means for controlling the maximum value of the voltage across the cathodes and anodes, the data electrodes and anodes and the data electrodes and cathodes of each of the discharge channels in such a manner as to not exceed a plasma discharge start voltage at periods other than periods of plasma discharge.

2. A plasma-addressed display device according to claim 1, wherein the controlling means is a means for fixing a data electrode voltage applied in a period from a plasma discharge occurring at one discharge channel to a plasma discharge starting at a following discharge channel and maintaining anode potential at a value at the center of a maximum amplitude of the data voltage.

3. A plasma-addressed display device according to claim 1, wherein individual barrier ribs are formed on the anodes and cathodes.

4. A plasma-addressed display device according to claim 1, wherein barrier ribs are formed only on the anodes.

5. A method for driving a plasma-addressed display device having a display cell composed of data electrodes arranged so as to be mutually parallel and a plasma cell for creating discharge channels formed in such a manner as to be orthogonal with respect to the data electrodes having anodes and cathodes alternately arrayed in such a manner as to be shared between adjacent discharge channels, with the display cell and the plasma cell being overlaid, comprising the step of:

ensuring that during the displaying of an image the maximum voltage across a cathode and an anode, a data electrode and an anode and a data electrode and a cathode does not exceed a plasma discharge start voltage at periods other than when a plasma discharge is taking place at each of the discharge channels.

6. A method for driving a plasma-addressed display device according to claim 5, wherein image displaying is carried out in such a manner that sequential selection is carried out by applying prescribed voltages to the anodes and cathodes and sequentially creating plasma discharges at the discharge channels, and data voltages are applied to the data electrodes.

7. A method for driving a plasma-addressed display device according to claim 5, wherein the voltage applied to the data electrodes is fixed and the anode potential is maintained as the central value of the maximum amplitude of the data voltage in the time between a plasma discharge at a discharge channel coming to an end and a plasma discharge starting at the following discharge channel.

* * * * *